US008419394B2

(12) United States Patent
Cho et al.

(10) Patent No.: US 8,419,394 B2
(45) Date of Patent: Apr. 16, 2013

(54) HERMETIC COMPRESSOR INCLUDING A BACKFLOW PREVENTING PORTION AND REFRIGERATION CYCLE DEVICE HAVING THE SAME

(75) Inventors: Nam-Kyu Cho, Seoul (KR); Hyo-Keun Park, Seoul (KR); Byeong-Chul Lee, Seoul (KR); Se-Heon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 762 days.

(21) Appl. No.: 12/591,264

(22) Filed: Nov. 13, 2009

(65) Prior Publication Data

US 2010/0122549 A1 May 20, 2010

(30) Foreign Application Priority Data

Nov. 14, 2008 (KR) ..... 10-2008-0113667

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 2/00*** | (2006.01) |

(52) U.S. Cl.

USPC ..... 418/88; 418/94; 418/97; 418/55.6; 418/270; 418/DIG. 1; 417/902

(58) Field of Classification Search ..... 418/88, 418/94, 97–99, 55.1–55.6, 57, 100, 270, 418/DIG. 1; 417/310, 410.5, 902; 184/6.16–6.18, 184/6.23

See application file for complete search history.

(56) References Cited

U.S. PATENT DOCUMENTS

| | | | | |
|---|---|---|---|---|
| 5,466,136 | A | 11/1995 | Yamada et al. | |
| 2007/0160488 | A1 | 7/2007 | Yoo et al. | |
| 2009/0035160 | A1 * | 2/2009 | Yoo et al. | 418/88 |

FOREIGN PATENT DOCUMENTS

| | | | | |
|---|---|---|---|---|
| JP | 2005-240637 | A | | 9/2005 |
| JP | 2005240637 | A | * | 9/2005 |
| JP | 2006152808 | A | * | 6/2006 |

* cited by examiner

*Primary Examiner* — Theresa Trieu

(74) *Attorney, Agent, or Firm* — McKenna Long & Aldridge LLP

(57) ABSTRACT

To a hermetic compressor and a refrigeration cycle device having the same, an oil separator for separating oil from a refrigerant discharged from a compression unit is added. Separated oil is recollected into an oil pump driven by a driving motor. Because refrigerant separated from the oil is prevented from being re-introduced into the compressor, a cooling capability of the refrigeration cycle device may be enhanced. Because the oil pump is driven by the driving force of the driving motor, the compressor may have a simplified configuration, and the fabrication costs may be reduced. The oil used for a crankshaft lubrication process is returned to the oil pump by forming an oil pocket between bearing surfaces of a crankshaft and the oil pump, oil may be prevented from back-flowing to the oil separator from the crankshaft. This may allow oil to be smoothly recollected into the oil pump.

8 Claims, 9 Drawing Sheets

HERMETIC COMPRESSOR INCLUDING A BACKFLOW PREVENTING PORTION AND REFRIGERATION CYCLE DEVICE HAVING THE SAME

This application claims priority to Korean Patent Application No. 10-2008-0113667, filed on Nov. 14, 2008 in the Republic of Korea, the contents of which is hereby incorporated by reference in its entirety.

BACKGROUND OF THE INVENTION

1. Field of the Invention

The present invention relates to a hermetic compressor and a refrigeration cycle device having the same, and particularly, to a hermetic compressor capable of separating oil from a refrigerant discharged from a compression unit and recollecting the oil to the hermetic compressor, and a refrigeration cycle device having the same.

2. Background of the Invention

A compressor is an apparatus for converting mechanical energy into fluid compression energy. A hermetic compressor is provided with a driving motor for generating a driving force, and a compression unit for compressing fluid by receiving the driving force of the driving motor. The driving motor and the compression unit are installed in an inner space of a casing.

In a hermetic compressor for use in a refrigerant compression type refrigeration cycle, a preset amount of oil is stored in the casing so as to cool the driving motor and/or lubricate and seal the compression unit. However, when the hermetic compressor is being driven, refrigerant discharged from the hermetic compressor may be discharged to the refrigeration cycle in a mixed state with oil. And, some of the oil discharged to the refrigeration cycle may remain in the refrigeration cycle without being recollected into the hermetic compressor, resulting in oil deficiency inside the hermetic compressor. This may lower reliability of the hermetic compressor, and the refrigeration cycle may have a lowered heat exchange performance due to the oil remaining therein.

In order to solve these problems, has been proposed an oil recollecting apparatus capable of preventing oil deficiency inside a compressor and maintaining a heat exchange performance by a refrigeration cycle, by separating oil from a refrigerant discharged from an outlet of the compressor by using an oil separator installed at the outlet, and by recollecting the separated oil into an inlet of the compressor. However, the conventional oil recollecting apparatus for a hermetic compressor has the following problems.

First, because an outlet of the conventional oil separator is connected to the inlet of the compressor having a relatively low pressure, not only the oil separated by the oil separator but also the refrigerant may backflow to the inlet of the compressor. This may cause the amount of the refrigerant which circulates in the refrigeration cycle to be deficient, thereby resulting in a low cooling capability of the refrigeration cycle.

Second, because high-temperature oil and refrigerant are sucked to the inlet of the compressor, a suction refrigerant has an increased temperature. This may increase a volume ratio of the refrigerant, and thus the amount of the refrigerant sucked to the compression unit of the compressor is reduced. This may result in a lowered cooling capability of the compressor.

Third, because the oil separated by the oil separator is mixed with a sucked refrigerant thus to be discharged from the compression unit, oil deficiency may occur within the inner space of the casing. This may lower the reliability of the compressor.

SUMMARY OF THE INVENTION

Therefore, a feature of the invention is a provision of a hermetic compressor capable of preventing temperature increase of a refrigerant discharged from the compressor and sucked to the hermetic compressor due to oil separated from the refrigerant, and capable of forcibly recollecting the oil separated from the refrigerant into the compressor, and a refrigeration cycle device having the same.

Another feature of the invention is a provision of a hermetic compressor capable of preventing oil recollected into the hermetic compressor after being separated from a refrigerant discharged from the compressor, from being discharged out in a mixed state with a refrigerant sucked into the compressor, and a refrigeration cycle device having the same.

To achieve these and other advantages and in accordance with the purpose of the present invention, as embodied and broadly described herein, there is provided a hermetic compressor, comprising: a casing configured to store oil in an inner space of the casing; a driving motor installed within the inner space of the casing; a compression unit installed within the inner space of the casing and configured to compress a refrigerant when driven by the driving motor; an oil separator in fluid communication with an outlet of the compressor and configured to separate oil from the compressed refrigerant discharged from the compression unit; an oil pump in fluid communication with the oil separator and configured to pump oil separated by the oil separator into the inner space of the casing; a crankshaft coupled to the driving motor, the compression unit, and the oil pump and configured to transmit a driving force of the driving motor to both the compression unit and the oil pump; and a backflow preventing portion formed at a housing which accommodates the oil pump and configured to prevent oil from back-flowing from the inner space of the casing to the oil separator.

According to another aspect of the present invention, there is provided a hermetic compressor, comprising: a casing configured to store oil in an inner space of the casing; a driving motor installed within the inner space of the casing; a compression unit installed within the inner space of the casing and configured to compress a refrigerant when driven by the driving motor; an oil separator in fluid communication with an outlet of the compressor and configured to separate oil from the compressed refrigerant discharged from the compression unit; a first oil pump in fluid communication with the oil separator and configured to pump oil separated by the oil separator into the inner space of the casing; a second oil pump in fluid communication with the inner space of the casing and configured to pump oil from the inner space of the casing; a crankshaft coupled to the driving motor, the compression unit, the first oil pump, and the second oil pump, and configured to transmit a driving force of the driving motor to the compression unit, the first oil pump, and the second oil pump, wherein the second oil pump pumps oil to bearing surfaces of the crankshaft and the compression unit; and a backflow preventing portion formed at a housing which accommodates the first oil pump, for preventing oil from back-flowing to the oil separator.

According to another aspect of the invention, there is provided the hermetic compressor having an inlet in fluid communication with an inlet of the compression unit; a condenser having an inlet and an outlet, the condenser inlet in fluid communication with the hermetic compressor outlet; an expander having an inlet and an outlet, the expander inlet in fluid communication with the condenser outlet; and an evaporator having an inlet and an outlet, the evaporator inlet in fluid communication with the expander outlet, the evaporator outlet in fluid communication with the hermetic compressor inlet.

The foregoing and other features, aspects, and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF EMBODIMENTS

Description will now be given in detail of embodiments of the invention, with reference to the accompanying drawings.

Hereinafter, a hermetic compressor and a refrigeration cycle device having the same according to an embodiment of the invention will be explained in more detail with reference to the attached drawings.

Figure 1:
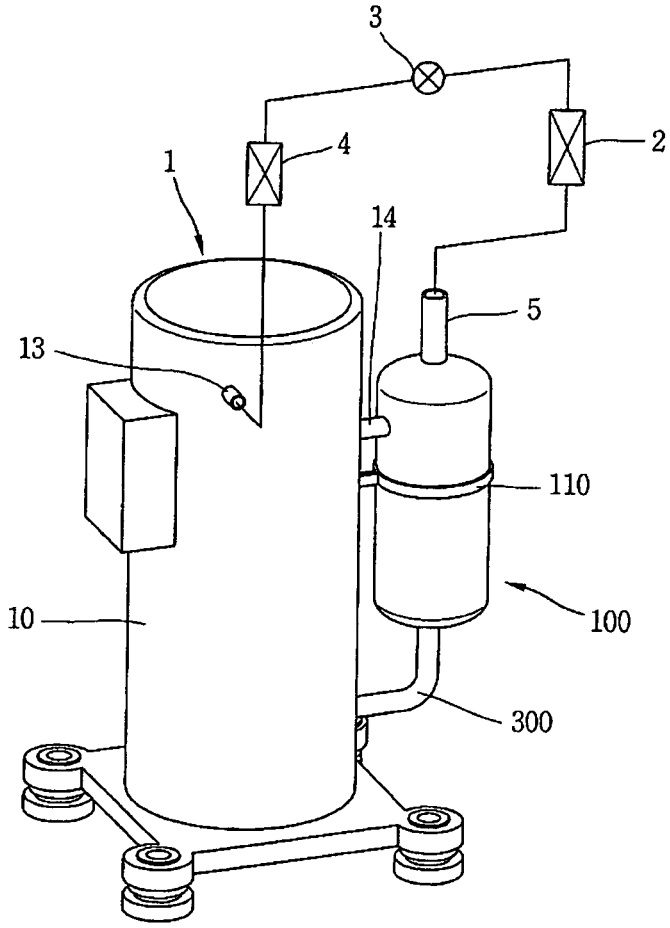
FIG. 1 is a perspective/schematic illustration showing an outside of a hermetic compressor connected to a refrigeration cycle according to an embodiment of the invention.
Figure 2:
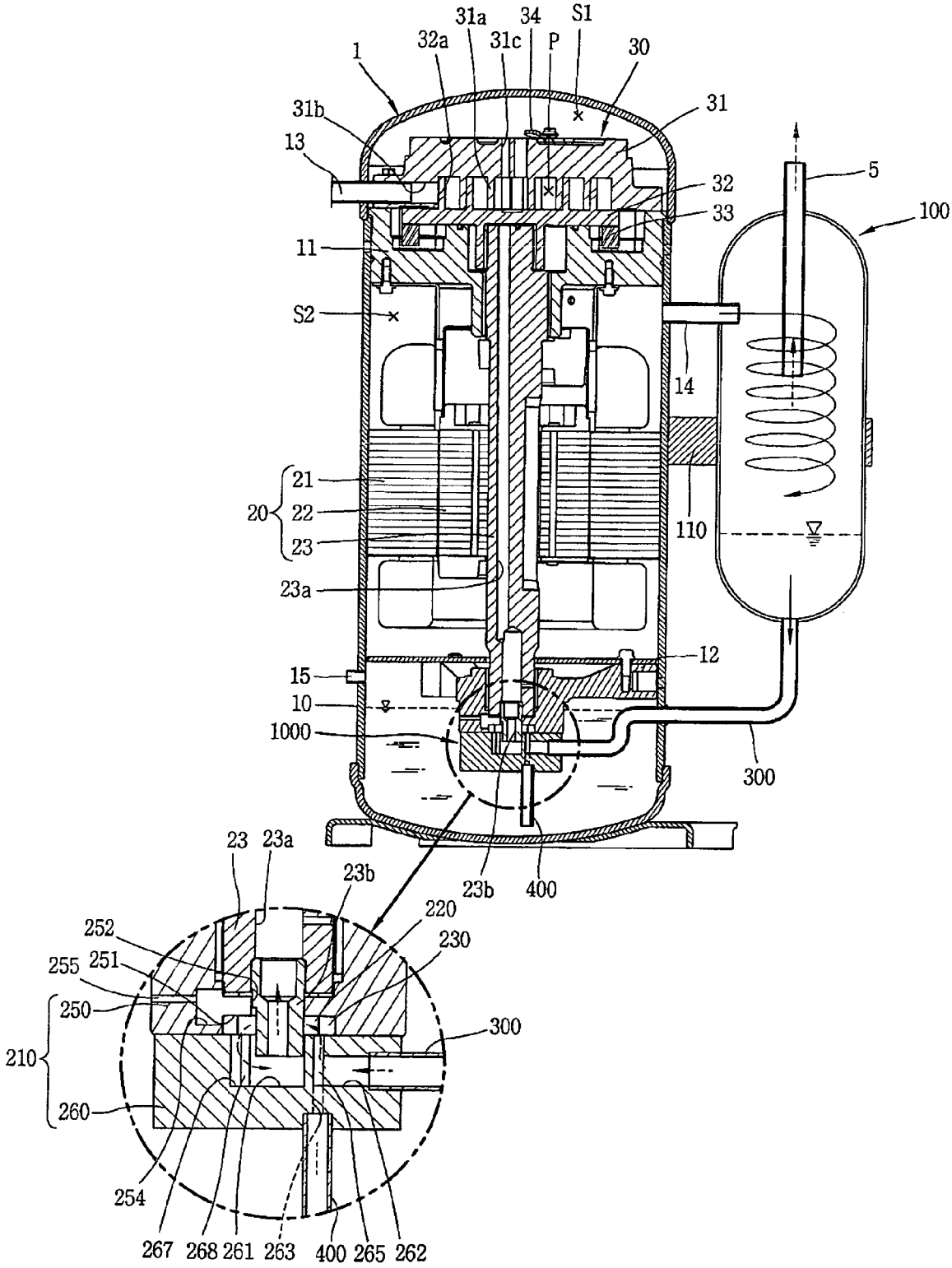
FIG. 2 is a longitudinal cross-sectional view showing an inside of the hermetic compressor of FIG. 1 wherein an oil pump is applied to a scroll compressor according an embodiment of the invention.

FIG. 1 is a perspective/schematic illustration showing an outside of a hermetic compressor connected to a refrigeration cycle according to an embodiment of the invention. FIG. 2 is a longitudinal cross-sectional view showing an inside of the hermetic compressor of FIG. 1 wherein an oil pump is applied to a scroll compressor according an embodiment of the invention.

As shown, the scroll compressor 1 comprises a compressor casing 10 having an inner space, a driving motor 20 installed within the inner space of the casing 10 and generating a driving force, and a compression unit 30 comprised of a fixed scroll 31 and an orbiting scroll 32 so as to compress a refrigerant while being driven by the driving force of the driving motor 20.

A main frame 11 and a sub-frame 12 for supporting not only a crankshaft 23 of the driving motor 20 but also the compression unit 30 are fixedly installed at upper and lower sides of the driving motor 20 within the inner space of the casing 10. A suction pipe 13 and a discharge pipe 14 are connected to the inner space of the casing 10 so that the compressor 1 can provide a refrigeration cycle in cooperation with a condenser 2, an expander 3, and an evaporator 4.

The suction pipe 13 may be connected to the evaporator 4 of the refrigeration cycle, whereas the discharge pipe 14 may be connected to the condenser 2 of the refrigeration cycle. The inner space of the casing 10 communicates with an outlet of the compression unit 30. The inner space of the casing 10 is adapted to be filled with oil and gaseous refrigerant having a high discharge pressure. Oil may be added through oil fill port 15. In the disclosed embodiments, the oil is stored at the bottom of the casing 10; its surface is depicted as a dashed line. The refrigerant occupies the inner space of the casing 10 above the surface of the oil. The suction pipe 13 is penetratingly formed at one side of the casing 10, and is in fluid communication with an inlet of the compression unit 30. A direct connection is acceptable. An oil separator 100, to be described later, may be installed at an intermediate position of the discharge pipe 14, e.g., between the outlet of the compressor 1 and an inlet of the condenser 2. The oil separator 100 may be secured to the outside of the compressor 1 using a bracket 110. The oil separator 100 serves to separate oil from the gaseous refrigerant discharged to the condenser 2 from the compressor 1 through the discharge pipe 14.

As the driving motor 20, a constant-speed motor having a constant rotation speed may be used. However, an inverter motor having a variable rotation speed may be used with consideration of a multi-function of a refrigeration cycle device to which the compressor 1 is applied.

In the embodiment of FIG. 2, the driving motor 20 includes a stator 21 fixed to an inner circumferential surface of the casing 10, a rotor 22 rotatably disposed in the stator 21, and a crankshaft 23 coupled to the center of the rotor 22 and transmitting a rotation force generated from the driving motor 20 to the compression unit 30. The crankshaft 23 may be supported by the main frame 11 and the sub-frame 12. An oil passage 23*a* may be penetratingly formed within the crankshaft 23 in a lengthwise direction. The oil passage may be, for example, along or parallel to the rotational axis of the crankshaft 23. An oil pump 1000, to be described later, may be installed at a lower end of the oil passage 23*a*, e.g., at a lower end of the crankshaft 23, so as to pump oil into the oil passage 23*a*.

As shown in the embodiment of FIG. 2, the compression unit 30 includes a fixed scroll 31 coupled to the main frame 11; an orbiting scroll 32 for forming one pair of compression chambers (P) which consecutively move by being engaged with the fixed scroll 31; an Oldham's ring 33 installed between the orbiting scroll 32 and the main frame 11, for inducing an orbiting motion of the orbiting scroll 32; and a backflow preventing valve 34 installed so as to open and close a discharge opening 31*c* of the fixed scroll 31, for preventing backflow of gas discharged through the discharge opening 31*c*. The fixed scroll 31 and the orbiting scroll 32 are provided with a fixed wrap 31*a* and an orbiting wrap 32*a*, respectively. The fixed wrap 31*a* and the orbiting wrap 32*a* are each formed in a spiral shape, and form the compression chambers (P) by being engaged with each other. The suction pipe 13 for guiding a refrigerant from the refrigeration cycle may be directly connected to a suction opening 31*b* of the fixed scroll 31. And, the discharge opening 31*c* of the fixed scroll 31 is communicated with the inner space of the casing 10.

Once power is supplied to the driving motor 20, the crankshaft 23 is rotated together with the rotor 22 to transmit a rotational force to the orbiting scroll 32. Then, the orbiting scroll 32 having received the rotational force performs an orbiting motion on an upper surface of the main frame 11 by an eccentric distance, thereby forming one pair of compression chambers (P) which consecutively move between the fixed wrap 31 a of the fixed scroll 31 and the orbiting wrap 32*a* of the orbiting scroll 32. As the compression chambers (P) have a decreased volume by moving toward its center, a sucked refrigerant is compressed. The compressed refrigerant is consecutively discharged to an upper space (S1) of the casing 10 through the discharge opening 31*c* of the fixed scroll 31, and then passes to a lower space (S2) of the casing 10 (together the "inner space" of the casing 10). Then, the compressed refrigerant is discharged to the condenser 2 of the refrigeration cycle through the discharge pipe 14. The refrigerant discharged from the condenser 2 of the refrigeration cycle is sucked into the compressor 1 through the suction pipe 13 via the expander 3 and the evaporator 4. These processes are repeatedly performed.

The oil pump 1000 may pump oil separated from the refrigerant discharged from the compression unit 30 into the inner space of the casing 10 and pump oil stored within the inner space of the casing 10 toward the driving motor 20 and the compression unit 30. Oil pumped toward the compression unit 30 and driving motor 20 may travel through the oil passage 23*a* of the crankshaft 23. The oil may perform a lubrication operation for the compression unit 30 and cooling operation for the driving motor 20.

The oil separator 100 for separating oil from the refrigerant discharged from the casing 10 may be installed at an outer side of the casing 10. One end of an oil recollection pipe 300 for guiding oil separated by the oil separator 100 to the oil pump 1000 is connected to a lower end of the oil separator 100. Another end of the oil recollection pipe 300 is connected to the oil pump 1000 by penetrating through the casing 10.

As shown in the embodiments of FIGS. 1 and 2, the oil separator 100 may be formed as a cylindrical enclosure having an inner space. The oil separator 100 may be disposed on either the outside or inside of the casing 10. In the disclosed embodiment, the oil separator 100 is disposed on the outside of the casing 10 and has its lengthwise axis oriented parallel to the lengthwise axis of the compressor 1. A lower end of the oil separator 100, e.g., an outlet, is connected to the oil recollection pipe 300 and may thus be supported by the casing 10, or by an additional supporting member 110 such as a supporting bracket fixed to the casing 10 and the oil separator 100.

Referring to FIG. 2, the discharge pipe 14 is connected to an upper wall surface of the oil separator 100 so that refrigerant discharged from the inner space of the casing 10 can be guided to the inner space of the oil separator 100. A refrigerant pipe 5 is connected to an upper end of the oil separator 100 so that a refrigerant separated from oil within the inner space of the oil separator 100 can be moved to the condenser 2 of the refrigeration cycle. The oil recollection pipe 300 is inserted into a lower end of the oil separator 100 at a predetermined height so that oil separated from the refrigerant within the inner space of the oil separator 100 can be guided to be recollected into the casing 10. The oil recollection pipe 300 may be implemented as a metallic pipe having strength strong enough to stably support the oil separator 100. The oil recollection pipe 300 may be curvedly-formed by an angle which allows the oil separator 100 and the casing 10 to be disposed in parallel to each other, so as to attenuate vibration from the compressor.

Oil may be separated from refrigerant in various manners. For instance, a mesh screen may be installed within the inner space of the oil separator 100 for separation of oil from refrigerant. Alternatively, the discharge pipe 14 may be connected to the oil separator 100 above the center of the oil separator 100, so that relatively heavy oil is separated from refrigerant while the refrigerant is rotated in the form of a cyclone within the inner space of the oil separator 100.

Figure 3:
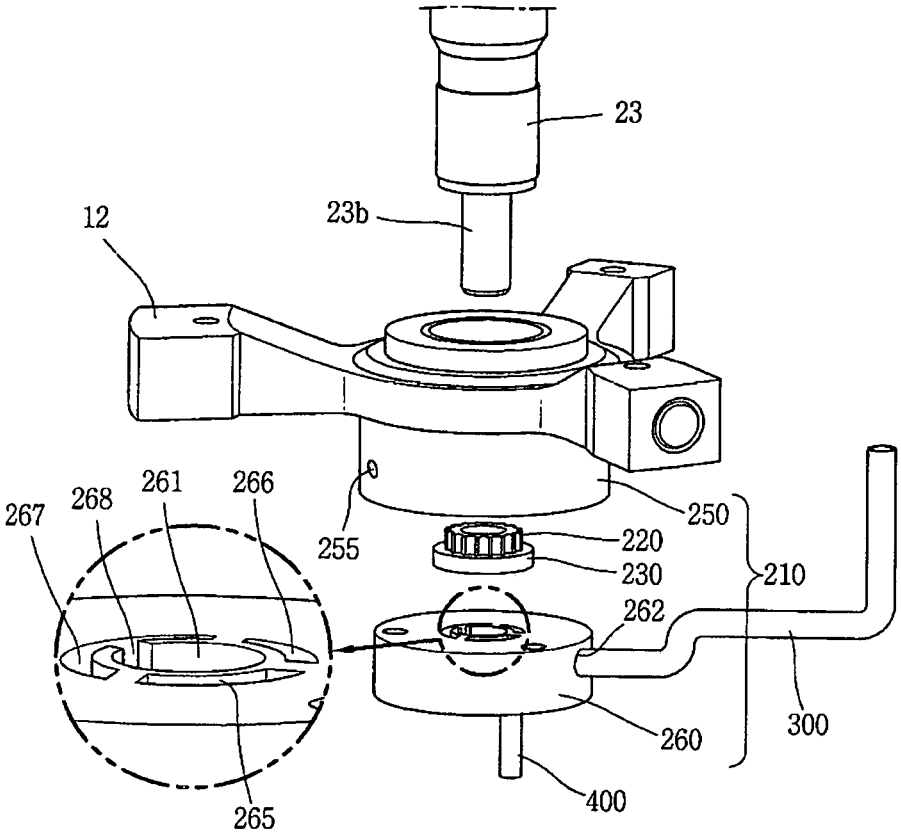
FIG. 3 is an exploded perspective view of the oil pump of FIG. 2.

The oil pump 1000 may be implemented as a variable capacity type oil pump such as a trochoid gear pump for pumping oil having a variable capacity. For example, as shown in FIGS. 2 and 3, the oil pump 1000 includes a pump housing 210 coupled to the sub-frame 12 at which the crankshaft 23 is supported. The oil pump 1000 may include a pumping space 251; an inner gear 220 rotatably disposed at the pumping space 251 of the pump housing 210, and eccentrically rotated in a coupled state to the crankshaft 23; and an outer gear 230 rotatably disposed at the pumping space 251 so as to form a variable capacity by being engaged with the inner gear 220.

The pump housing 210 includes an upper housing 250 coupled to the sub-frame 12; and a lower housing 260 coupled to a lower end of the upper housing 250, and forming the pumping space 251 at a position between itself and the upper housing 250.

Figure 4:
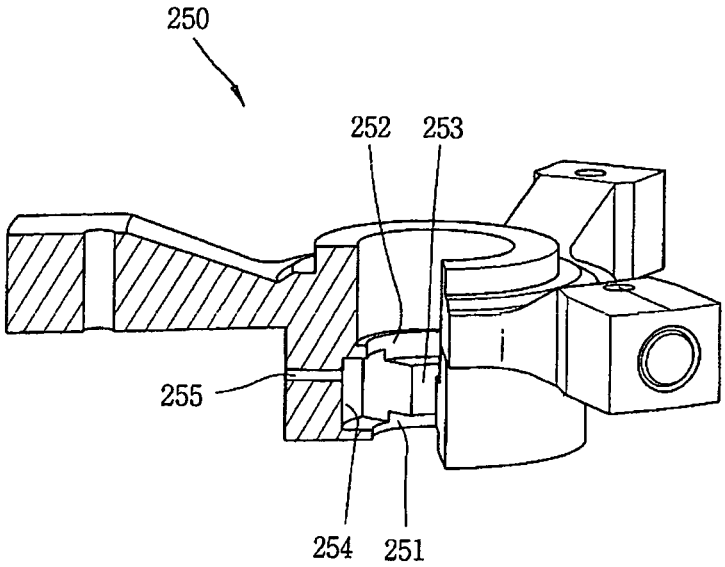
FIG. 4 is a cut-away perspective view of an upper housing of the oil pump of FIG. 3.
Figure 5:
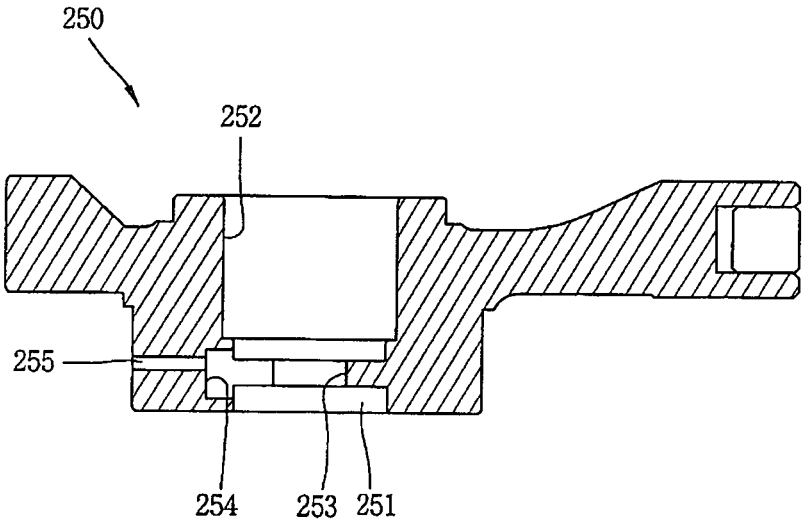
FIG. 5 is a longitudinal cross-sectional view of an upper housing of the oil pump of FIG. 3.

Referring to FIGS. 4 and 5, a shaft groove 252 for inserting the crankshaft 23 is formed on an upper surface of the upper housing 250 at a predetermined depth. A pin hole 253 for penetratingly-inserting a pin portion 23*b* of the crankshaft 23 is formed at the center of the shaft groove 252. An oil pocket 254, implemented as a backflow preventing portion, is formed at one side of the pin hole 253, e.g., on inner circumferential surfaces of the shaft groove 252 and the pumping space 251. The oil pocket 254 collects oil that has performed a lubrication operation for bearing surfaces of the crankshaft 23, thereby preventing the oil from back-flowing into the oil separator 100, for example, from the oil passage 23*a*. A discharge hole 255 is formed at an upper end of the oil pocket 254 so that any air bubbles collected in the oil pocket 254 can flow into the inner space of the casing 10 along with the oil that has performed the lubrication operation.

In an embodiment, the oil pocket 254 is formed so as to be in fluid communication with a discharge capacity portion (V2) of the oil pump 1000 so that oil collected in the oil pocket 254 can flow to the discharge capacity portion (V2) of the oil pump 1000.

Figure 6:
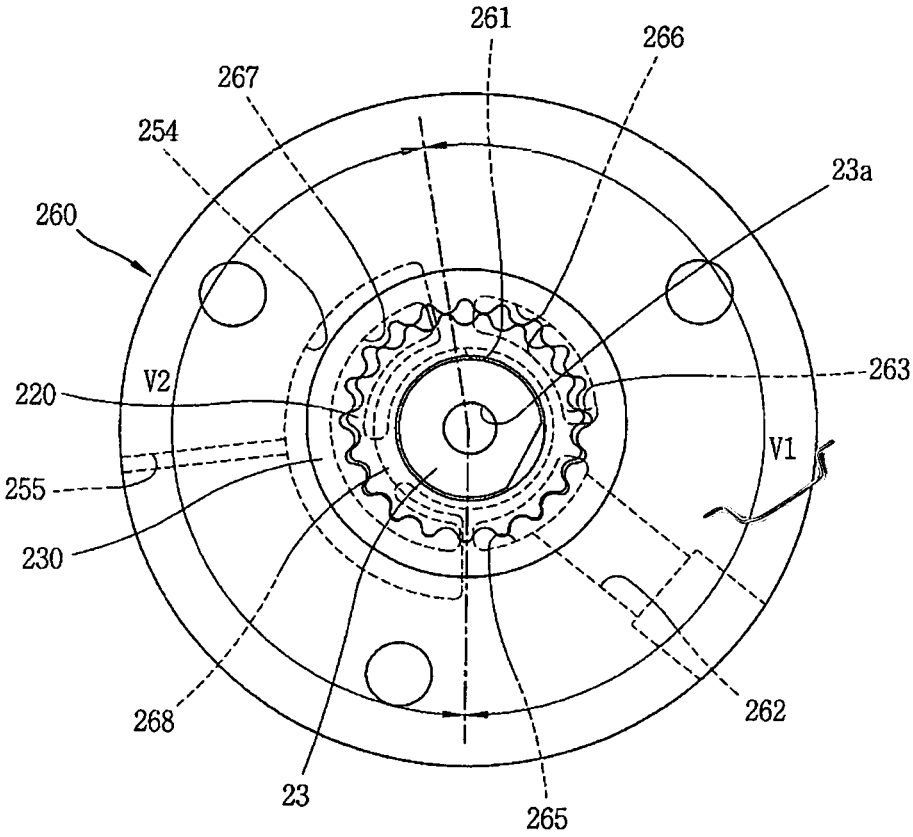
FIG. 6 is a planar view of an upper surface of a lower housing including an inner gear and an outer gear in the oil pump of FIG. 3.
Figure 7:
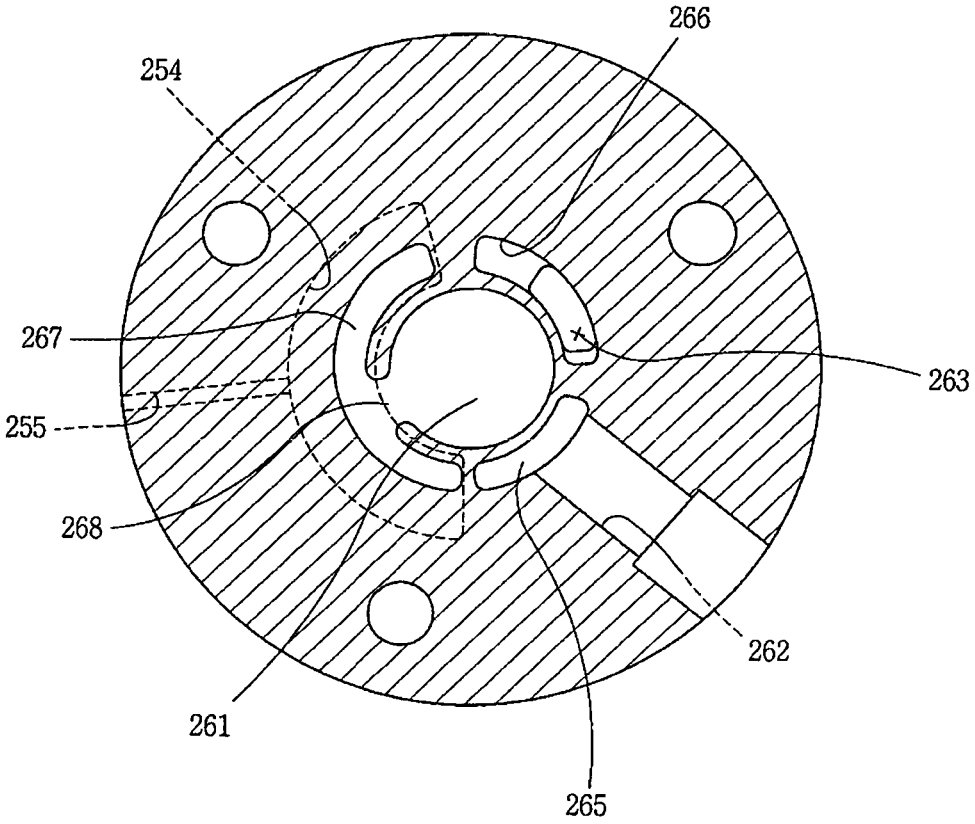
FIG. 7 is a top planar cross-sectional view of the lower housing of the oil pump of FIG. 3, with the inner gear and the outer gear removed.

As shown in FIGS. 6 and 7, a communication groove 261 communicated with the oil passage 23*a* of the crankshaft 23 is formed at the center of an upper surface of the lower housing 260. A first suction guide groove 265 communicated with a first suction opening 262 is formed at the periphery of one side of the communication groove 261, e.g., at a contact surface between the inner gear 220 and the outer gear 230. A second suction guide groove 266 communicated with a second suction opening 263 is formed at one side of the first suction guide groove 265 in a circumferential direction. A discharge guide groove 267 is formed at an opposite side to the first suction guide groove 265 and the second suction guide groove 266. The first suction opening 262 and the second suction opening 263 may be formed to be communicated with each other. However, in the event of the occurrence of a pressure difference between the first suction opening 262 and the second suction opening 263, oil may backflow. In order to prevent this problem, it is preferable that the first suction opening 262 and the second suction opening 263 are formed on the same plane, but are otherwise separated from each other so as not to be in direct communication with each other.

Each of the first suction guide groove 265 and the second suction guide groove 266 is formed in a circular arc shape having an angle of about 90°. The first suction guide groove 265 and the second suction guide groove 266 are separated from each other by a partition wall. The discharge guide groove 267 is formed in a circular arc shape having an angle of about 180°. A discharge slit 268 communicated with the communication groove 261 is formed on an inner wall of the discharge guide groove 267.

A variable capacity formed by the inner gear 220 and the outer gear 230 is comprised of a suction capacity portion (V1) and a discharge capacity portion (V2). Referring to FIG. 6, the suction capacity portion (V1) is formed to have an increased volume along a rotation direction of the inner gear 220, from a starting end of the first suction guide groove 265 in a circumferential direction, to a finishing end of the second suction guide groove 266. The discharge capacity portion (V2) is formed to have a decreased volume along a rotation direction of the inner gear 220, from a starting end to a finishing end of the discharge guide groove 267.

Returning to FIG. 2, an oil supply hole 15 for supplying oil to the inner space of the casing 10 is formed at a lower part of the casing 10. When a plurality of compressors are used, the oil supply hole 15 may be used as an oil level balancing hole, the oil level balancing hole may be in fluid communication with the plurality of oil level balancing holes in the plurality of compressors, respectively. By fluid communication of these holes, the oil height in each of the plurality of compressors may be made equal.

Hereinafter, a process for recollecting oil that has performed a lubrication operation, and recollecting oil separated from refrigerant, into the inner space of the casing 10, and then supplying the recollected oil to, for example, the compression unit 30 by the oil pump 1000 will be described.

Referring to FIG. 3, while the inner gear 220 of the oil pump 1000 is eccentrically rotated in a coupled state with the crankshaft 23, the suction capacity portion (V1) and the discharge capacity portion (V2) are formed between the inner gear 220 and the outer gear 230. As the first suction opening 262 and the second suction opening 263 are communicated with each other, oil separated from a refrigerant by the oil separator 100 is introduced into the first suction guide groove 265 through the oil recollection pipe 300. Meanwhile, oil stored in the casing 10 is introduced into the second suction guide groove 266 through an oil suction pipe 400. The oil introduced into the first suction guide groove 265 is stored in the suction capacity portion (V1), and then is introduced into the second suction guide groove 266 via the partition wall. The oil introduced into the second suction guide groove 266 is moved to the discharge capacity portion (V2) from the suction capacity portion (V1).

Next, the oil moved to the discharge capacity portion (V2) is introduced into the discharge guide groove 267, and then is introduced into the communication groove 261 through the discharge slit 268 provided on an inner circumferential wall of the discharge guide groove 267. Then, the oil introduced into the communication groove 261 flows to the oil passage 23*a* of the crankshaft 23. Oil within the oil passage 23*a* is upwardly pushed through the oil passage 23*a*, and then is upwardly pulled by a centrifugal force of the crankshaft 23. A portion of the oil pumped into oil passage 23*a* is supplied to bearing surfaces, and the remaining portion of the oil is dispersed toward an upper end of the crankshaft 23 thus to be introduced into the compression unit 30. These processes are repeatedly performed.

Figure 8:
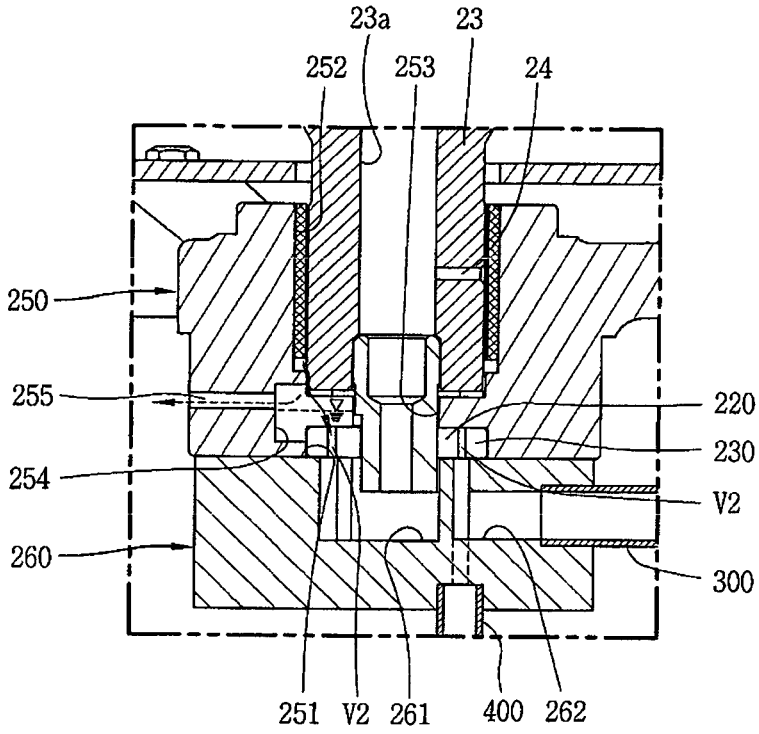
FIG. 8 is a longitudinal cross-sectional view of the oil pump of the compressor of FIG. 2.

As shown in FIG. 8, the oil sucked to the oil passage 23*a* of the crankshaft 23 by the oil pump 1000 flows to an outer circumferential surface of the crankshaft 23 through an oil hole 24 (FIG. 8) of the crankshaft 23, thereby performing a lubrication operation for bearing surfaces of the crankshaft 23. Then, the oil having performed a lubrication operation for bearing surfaces flows down along the outer circumferential surface of the crankshaft 23, thereby being collected into the oil pocket 254. Then, the collected oil is supplied to the discharge capacity portion (V2) between the inner gear 220 and the outer gear 230 of the oil pump 1000. This allows the outlet of the oil pump 1000 to always maintain a state filled with oil. Accordingly, a pressure of the discharge capacity portion (V2) of the oil pump 1000 is prevented from being lower than a pressure of the oil passage 23*a* of the crankshaft 23 communicated with the discharge capacity portion (V2). This prevents backflow of the oil in the oil passage 23*a* of the crankshaft 23 to the discharge capacity portion (V2) of the oil pump 1000 due to a pressure difference therebetween, thereby allowing the oil to be smoothly pumped into the oil passage 23*a*. Air bubbles that may be generated while the oil is lubricating the bearing surfaces of the crankshaft 23 are collected in the oil pocket 254, and then are discharged to the inner space of the casing 10 through the discharge hole 255 provided at the upper end of the oil pocket 254. Accordingly, air bubbles are prevented from being introduced into the oil passage 23*a* of the crankshaft 23.

Oil separated from refrigerant by the oil separator 100 is recollected into the oil pump 1000 through the oil recollection pipe 300, and then is directly supplied to the bearing surfaces and the compression unit 30. However, the oil recollected into the oil pump 1000 through the oil recollection pipe 300 may include foreign materials, such as welding byproducts generated when the compressor is assembled. Accordingly, the foreign materials have to be filtered in order to prevent abrasion of the bearing surfaces and the compression unit 30. Preferably, a foreign material separator (not shown) for filtering foreign materials included in oil is installed at an intermediate part of the oil recollection pipe 300.

As oil separated from a refrigerant by the oil separator 100 is forcibly recollected into the compressor by the oil pump 1000, the amount of recollected oil available for the bearing surfaces and the compression unit 30 is increased. This may enhance a heat exchange performance of the refrigeration cycle, thereby enhancing a cooling capability of the refrigeration cycle.

As the oil forcibly recollected into the compressor unit 30 from the pump 1000 is directly introduced into the oil passage 23*a* of the crankshaft 23 without passing through the inner space of the casing 10, the oil is prevented from being discharged out of the compressor 1 after being re-mixed with refrigerant in the inner space of the casing 10. Because the oil in the oil passage 23*a* has already had refrigerant separated from it by operation of the oil separator 100, the experience of having refrigerant re-expand in the inner space of the casing 10 and thereby reduce the performance and reliability of the compressor is avoided. This may enhance the performance and reliability of the compressor, and may enhance a cooling capability of the refrigeration cycle.

According to the embodiments described herein, at least because the oil having performed a lubrication operation for the bearing surfaces of the crankshaft 23 is collected for supply to the discharge capacity portion (V2) of the oil pump 1000, oil flowing in the oil passage 23*a* of the crankshaft 23 is prevented from back-flowing to the discharge capacity portion (V2) of the oil pump 1000. This may allow oil to be more smoothly pumped to the oil passage 23*a* of the crankshaft 23.

In the embodiment described above, oil is recollected and pumped using one oil pump 1000, the oil pump 1000 may be designed to reduce fabrication costs. Furthermore, as the oil pump 1000 is driven by the driving force of the driving motor 20, the compressor 1 may have a simplified configuration, resulting in additional reduction of fabrication costs.

Hereinafter, an oil pump according to another embodiment of the present invention will be described. In the aforementioned embodiment, one oil pump 1000 was used to both recollect oil separated from a refrigerant by the oil separator 100 and to pump oil stored within the inner space of the casing into the oil passage 23*a* of the crankshaft 23. However, in the second embodiment, a plurality of oil pumps 1200, 1300 are provided.

Figure 9:
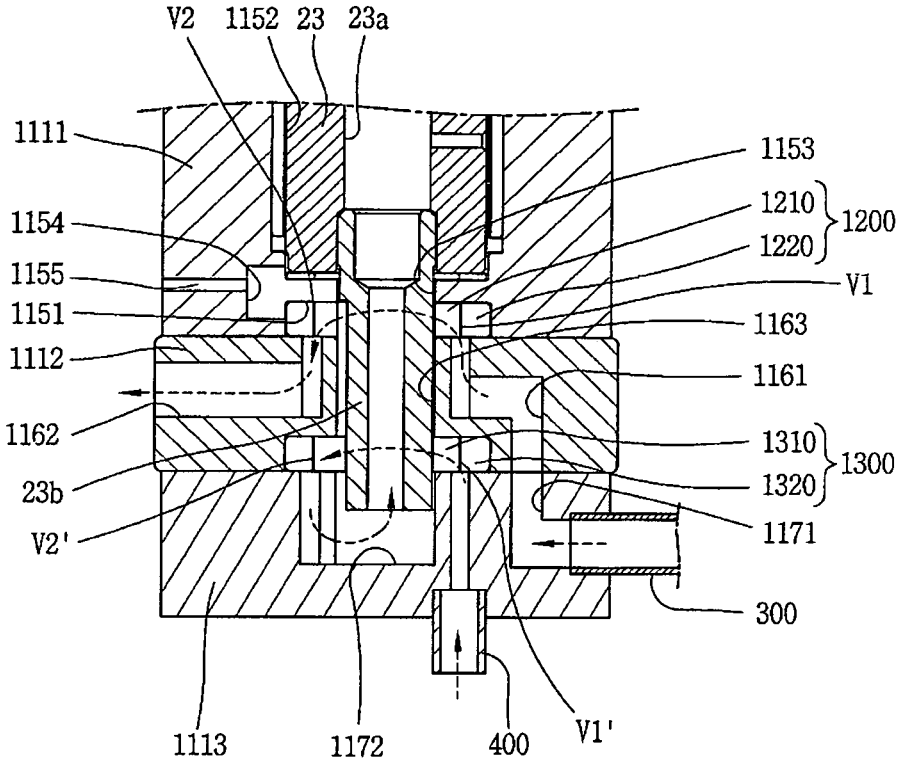
FIG. 9 is a longitudinal cross-sectional view of an alternate embodiment of an oil pump for use in the compressor of FIG. 1.

In the embodiment of FIG. 9, a first oil pump 1200 is configured to recollect oil from the oil separator 100, whereas a second oil pump 1300 is configured to pump oil stored within the inner space of the casing 10 into the oil passage 23*a* of the crankshaft 23. For this, the first oil pump 1200 and the second oil pump 1300 may be implemented as trochoid gear pumps having first and second variable capacities, similar to the oil pump 1000 of the first embodiment. As illustrated in the embodiment of FIG. 9, the first oil pump 1200 and the second oil pump 1300 may be arranged at upper and lower sides of each other in an axial direction, e.g., along the axis of rotation of the two pumps.

As illustrated in FIG. 9, at a bottom surface of an upper housing 1111, formed is a first pumping space 1151 for inserting a first inner gear 1210 and a first outer gear 1220. At an upper surface of the upper housing 1111, formed is a shaft groove 1152 for inserting the crankshaft 23. Between the shaft groove 1152 and the first pumping space 1151, formed is a first pin hole 1153 for penetratingly-inserting a pin portion 23*b* of the crankshaft 23. An oil pocket 1154 for collecting oil that has performed a lubrication operation for bearing surfaces of the crankshaft 23 is formed at one side of the pin hole 1153, e.g., on inner circumferential surfaces of the shaft groove 1152 and the pumping space 1151. A discharge hole 1155 is formed at an upper end of the oil pocket 1154 so that any air bubbles collected in the oil pocket 1154 together with oil collected in the oil pocket 1154 can flow to the inner space of the casing 10.

The oil pocket 1154 is formed at a position in communication with a discharge capacity portion (V2) of the first oil pump 1200 so that oil collected in the oil pocket 1154 can flow to the discharge capacity portion (V2) of the first oil pump 1200.

Reference numeral 300 denotes an oil recollection pipe, 400 denotes an oil suction pipe, 1112 denotes an intermediate housing, 1113 denotes a lower housing, 1161 denotes a communication hole, 1162 denotes a first discharge opening, 1163 denotes a second pin hole, 1171 denotes a second suction opening, 1172 denotes a communication groove, 1310 denotes a second inner gear for second oil pump 1300, and 1320 denotes a second outer gear for second oil pump 1300.

An oil flow processes for the embodiment where the oil pocket 1154 is formed in the upper housing 1111 is now described.

Oil pumped to the oil passage 23*a* of the crankshaft 23 by the second oil pump 1300 flows through an oil hole 24 of the crankshaft 23, thereby performing a lubrication operation for bearing surfaces of the crankshaft 23. Then, the oil having performed a lubrication operation for bearing surfaces, flows down along an outer circumferential surface of the crankshaft 23 and is collected in the oil pocket 1154 of the upper housing 1111. The oil collected in the oil pocket 1154 is supplied to a first discharge capacity portion (V2) between the first inner gear 1210 and the first outer gear 1220 of the first oil pump 1200. Accordingly, an outlet of the first oil pump 1200 always maintains an oil-filled state. This may prevent the oil inside the casing 10 from back-flowing into the outlet of the first oil pump 1200, and allow the oil to be smoothly recollected into the casing 10.

Any air bubbles generated while the oil lubricates bearing surfaces of the crankshaft 23 are collected in the oil pocket 1154, and then are discharged to the inner space of the casing 10 through the discharge hole 1155 provided at the upper end of the oil pocket 1154. Accordingly, air bubbles are prevented from being introduced into the oil passage 23*a* of the crankshaft 23.

The scroll compressor having a plurality of oil pumps according to the second embodiment has the same operational effects as the scroll compressor according to the first embodiment. For instance, in both the first and second embodiments, because the oil having performed a lubrication operation for the bearing surfaces is returned to the discharge capacity portion V2 of the oil pump (1000, FIG. 2; 1200, FIG. 9), oil is more smoothly recollected into the compressor. However, the second embodiment is different from the first embodiment in that the oil pump of the second embodiment is configured in plurality (first oil pump 1200 and second oil pump 1300, although the plurality is not limited to two pumps). In the embodiment of FIG. 9, first oil pump 1200 serves to pump oil recollected from the oil separator 100 into the inner space of the casing 10, whereas the second oil pump 1300 serves to pump oil stored in the inner space of the casing 10 to the oil passage 23*a* of the crankshaft 23. Accordingly, the oil pocket 1154 may be formed so as to be in fluid communication with discharge capacity portions, V2 and V2', of the two oil pumps 1200 and 1300, respectively. Alternatively, the oil pocket 1154 may be formed so as to be in fluid communication with a discharge capacity portion of only one of the two oil pumps 1200 and 1300.

In the embodiment of FIG. 9, it is envisioned that the inlet of the second oil pump 1300 is always in an immersed state in the oil stored in the inner space of the casing 10. Because the inlet is always in an immersed state, the oil has a low probability of backflowing to the inner space of the casing 10 from the crankshaft 23. However, because an inlet of the first oil pump 1200 is communicated with the oil recollection pipe 300, oil may not be smoothly recollected into the compressor according to a driving state of the compressor. This may cause the oil inside the casing 10 to backflow to the second oil pump 1300.

Accordingly, in the case of communicating the oil pocket 1154 with one oil pump, the oil pocket 1154 is preferably communicated with the discharge capacity portion V2 of the first oil pump 1200, not with the discharge capacity portion V2' of the second oil pump 1300. FIG. 9 illustrates the example of the oil pocket 1154 that is in fluid communication with the first oil pump 1200.

Figure 10:
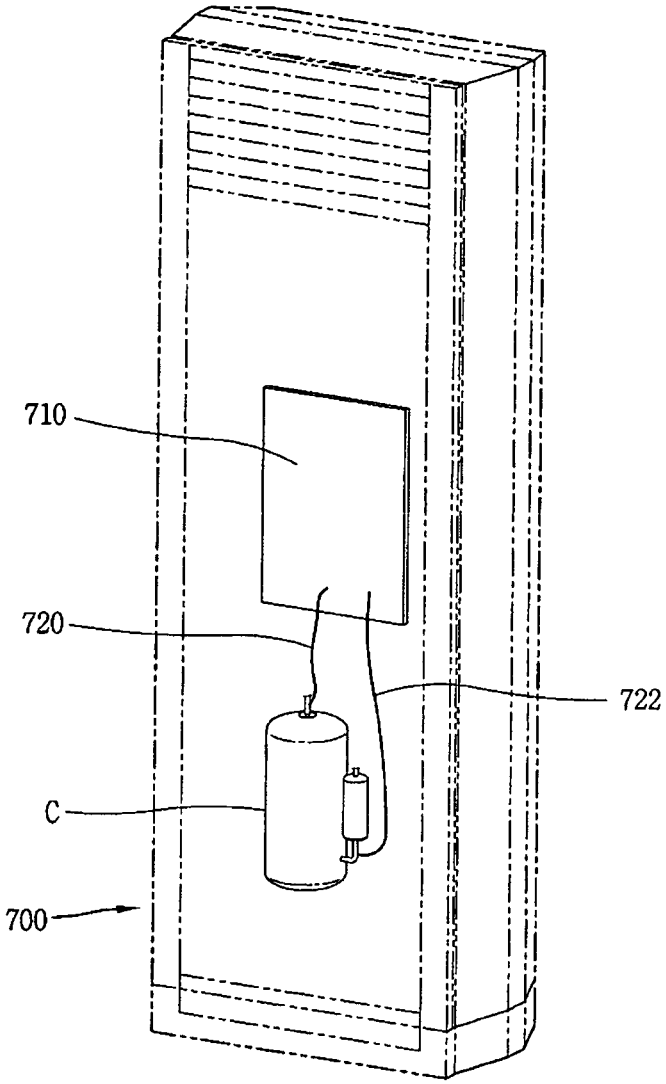
FIG. 10 is a view schematically showing a refrigeration cycle device having the hermetic compressor of FIG. 1.

Referring to FIG. 10, a refrigeration cycle device 700 includes a refrigerant compression type refrigeration cycle which includes a compressor, a condenser, an expander, and an evaporator, all according to the embodiments of the invention described herein. The compressor of the device 700 is a scroll compressor (C) having an oil pump according to one of the embodiments described herein. The scroll compressor (C) operationally communicates with a controller 710 via one or more communication busses or electrical signal wires 720, 722. The controller 710 may control the operation of the refrigeration cycle device 700. In the scroll compressor (C), the oil pocket for collecting oil having performed a lubrication operation for the bearing surfaces is formed at the outlet of the oil pump, thereby preventing the oil inside the casing from back-flowing to the oil pump. This may implement the aforementioned effects, and may enhance the performance of the refrigeration cycle device to which the scroll compressor has been applied.

When a scroll compressor according to an embodiment of the invention is applied to a refrigeration cycle device, the refrigeration cycle device may have enhanced performance.

The hermetic compressor and the refrigeration cycle device having the same have the following advantages.

First, the oil separator for separating oil from the refrigerant discharged from the compression unit is installed inside or outside the casing. The oil separated by the oil separator 100 is recollected into the oil pump driven by a driving force of the driving motor. Accordingly, the oil may be effectively separated from the refrigerant, and the fabrication costs may be reduced.

Second, because the refrigerant separated from the oil is prevented from being re-introduced into the compressor, a cooling capability of the refrigeration cycle device may be enhanced.

Third, because the oil pump is driven by the driving force of the driving motor, the compressor may have a simplified configuration, and the fabrication costs may be reduced.

Fourth, because the oil having performed the lubrication process is filled in the discharge capacity portion of the oil pump by using the oil pocket, oil may be prevented from back-flowing to the outlet of the oil pump from the oil passage of the crankshaft. This may allow oil to be smoothly recollected into the compressor.

So far, it was explained that the present invention was applied to a scroll compressor. However, the present invention may be also applied to a so-called hermetic compressor, such as a rotary compressor and a reciprocating compressor, that a driving motor and a compression unit are installed in the same casing, and an inner space of the casing is filled with a discharged refrigerant.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A hermetic compressor, comprising:

a casing configured to store oil in an inner space of the casing;

a driving motor installed within the inner space of the casing;

a compression unit installed within the inner space of the casing and configured to compress a refrigerant when driven by the driving motor;

an oil separator in fluid communication with an outlet of the compressor and configured to separate oil from the compressed refrigerant discharged from the compression unit;

an oil pump in fluid communication with the oil separator and configured to pump oil separated by the oil separator into the inner space of the casing, wherein the oil pump is implemented as a variable capacity type oil pump, which forms a variable capacity as an inner gear and an outer gear thereof perform a relative motion while being rotationally engaged with each other;

a crankshaft coupled to the driving motor, the compression unit, and the oil pump and configured to transmit a driving force of the driving motor to both the compression unit and the oil pump, an oil passage is formed at the crankshaft such that oil received in the variable capacity type oil pump from the oil separator is pumped to the oil passage; and a backflow preventing portion formed at a housing which accommodates the oil pump and configured to prevent oil from back-flowing from the inner space of the casing to the oil separator, wherein the backflow preventing portion is implemented as an oil pocket formed between the variable capacity type oil pump and the oil passage such that oil used to lubricate bearing surfaces of the crankshaft flows from the bearing surfaces into the oil pocket and flows from the oil pocket into the variable capacity type oil pump.

2. The hermetic compressor of claim 1, wherein an oil pocket is formed such that the bearing surfaces of the crankshaft and the oil pump are in fluid communication with each other.

3. The hermetic compressor of claim 2, further comprising:

a frame configured to for support the crankshaft, and wherein the oil pocket is formed so as to be in fluid communication with the bearing surfaces between the crankshaft and the frame.

4. The hermetic compressor of claim 3, wherein a pumping space for accommodating the inner gear and the outer gear therein is formed in the frame, and wherein the oil pocket is formed on an inner circumferential surface of the pumping space at a preset depth.

5. The hermetic compressor of claim 3, wherein a discharge hole for communicating the oil pump with the inner space of the casing is formed in the frame.

6. The hermetic compressor of claim 2, wherein the variable capacity type oil pump comprises a suction capacity portion communicated with the oil separator, and a discharge capacity portion communicated with the oil passage, the suction capacity portion and the discharge capacity portion consecutively formed in a circumferential direction, and wherein the oil pocket is formed such that oil collected therein is received in the discharge capacity portion.

7. A refrigeration cycle device, comprising:

the hermetic compressor of claim 1, the hermetic compressor having an inlet in fluid communication with an inlet of the compression unit;

a condenser having an inlet and an outlet, the condenser inlet in fluid communication with the hermetic compressor outlet;

an expander having an inlet and an outlet, the expander inlet in fluid communication with the condenser outlet; and an evaporator having an inlet and an outlet, the evaporator inlet in fluid communication with the expander outlet, the evaporator outlet in fluid communication with the hermetic compressor inlet.

8. The refrigeration cycle device of claim 7, wherein:

the condenser inlet is in fluid communication with the inner space of the casing via the oil separator, and the evaporator outlet is directly connected to the compression unit inlet.

* * * * *